US008459749B2

(12) United States Patent
Klabisch et al.

(10) Patent No.: US 8,459,749 B2
(45) Date of Patent: Jun. 11, 2013

(54) ROOF CUTTER HOLDER ADJUSTMENT DEVICE AND SECURING ELEMENT THEREFOR

(75) Inventors: Adam Klabisch, Dortmund (DE); Gerhard Siepenkort, Lunen (DE); Klaus Duhnke, Werne (DE); Norbert Hesse, Bochum (DE)

(73) Assignee: Caterpillar Global Mining Europe GmbH, Lunen (DE)

( * ) Notice: Subject to any disclaimer, the term of this patent is extended or adjusted under 35 U.S.C. 154(b) by 306 days.

(21) Appl. No.: 12/812,099

(22) PCT Filed: Jan. 5, 2009

(86) PCT No.: PCT/EP2009/000012

§ 371 (c)(1),
(2), (4) Date: Aug. 12, 2010

(87) PCT Pub. No.: WO2009/087078

PCT Pub. Date: Jul. 16, 2009

(65) Prior Publication Data

US 2010/0294055 A1 Nov. 25, 2010

(30) Foreign Application Priority Data

Jan. 11, 2008 (DE) ..... 20 2008 000 527 U

(51) Int. Cl.
*E21C 27/44* (2006.01)

(52) U.S. Cl.
USPC ..... 299/34.03; 299/34.02; 299/34.08; 299/34.11; 299/80.1

(58) Field of Classification Search
CPC ..... E21C 27/32; E21C 27/34; E21C 31/08
USPC ..... 299/34.02, 34.03, 34.04, 34.08, 34.11, 299/80.01
See application file for complete search history.

(56) References Cited

U.S. PATENT DOCUMENTS

| | | | | |
|---|---|---|---|---|
| 2,801,094 | A * | 7/1957 | Ball | 299/80.1 |
| 3,469,886 | A * | 9/1969 | Marberg | 299/80.1 |
| 4,275,927 | A | 6/1981 | Merten et al. | |
| 4,548,444 | A * | 10/1985 | Breuer et al. | 299/34.11 |
| 2007/0090677 | A1 * | 4/2007 | Bettermann et al. | 299/34.04 |

FOREIGN PATENT DOCUMENTS

| | | | |
|---|---|---|---|
| DE | 2836133 | A1 | 2/1980 |
| DE | 19637973 | A1 | 3/1998 |
| DE | 20113918 | U1 | 4/2002 |
| DE | 10320169 | A1 | 12/2004 |
| DE | 202005016177 | U1 | 12/2005 |

* cited by examiner

*Primary Examiner* — David Bagnell
*Assistant Examiner* — Benjamin Fiorello
(74) *Attorney, Agent, or Firm* — Foley & Lardner LLP

(57) ABSTRACT

A roof cutter holder adjustment device for a roof cutter holder arranged in a vertically adjustable manner on a plow body of a winning plow, comprising a worm wheel for interacting with a rack-like tooth system on the roof cutter holder, an input shaft for actuating the worm wheel, and comprising a head plate which has a passage for the input shaft and which can be fastened or is fastened to the plow body in a rotationally fixed manner. In order to enable the roof cutter holder adjustment device to be mounted and released in a simple manner, the head plate has at least one fastening device, to which a securing element which can be put onto the free end of the input shaft can be fastened in a rotationally fixed manner in the mounted state.

20 Claims, 2 Drawing Sheets

ROOF CUTTER HOLDER ADJUSTMENT DEVICE AND SECURING ELEMENT THEREFOR

This application claims priority to and the benefit of the filing date of International Patent Application No. PCT/EP2009/000012, filed Jan. 5, 2009, which application claims priority to and the benefit of the filing date of German Patent Application No. 20 2008 000 527.2, filed Jan. 11, 2008.

FIELD OF THE INVENTION

The invention relates to a roof cutter holder adjustment device for a roof cutter holder arranged in a vertically adjustable manner on a plow body of a winning plow, comprising a worm wheel for interacting with a rack-like tooth system on the roof cutter holder, comprising an input shaft for actuating the worm wheel, preferably comprising a gear unit interposed between the input shaft and the worm wheel, and comprising a head plate which has a passage for the input shaft, wherein the head plate can be fastened or is fastened to the plow body in a rotationally fixed manner. The invention also relates to a securing element for such a roof cutter holder adjustment device.

BACKGROUND

A roof cutter holder adjustment device is known from DE 20 2005 016 177 U1. The known roof cutter holder adjustment device, which is used in particular on plow bodies for drag-hook plows and uses an epicyclic gear unit which is mounted in an interchangeable construction unit and acts as a torque multiplier and thus makes possible the expenditure of force for adjusting the roof cutter holder itself at underground longwall faces in restricted space conditions in a relatively simple manner and with a low expenditure of force, can be removed by releasing the head plate from the plow body and, if the tooth system of the worm wheel is worn or if the gear unit or the like is sluggish, can be exchanged relatively simply for another roof cutter holder adjustment device. In underground operational use, e.g. when mining coal using a winning plow at the longwall face, the cutters fastened to the roof cutter holder are in contact with the working face when the plow body travels back and forth, for which reason unintentional adjusting movements of the roof cutter holder or undesirable vibrations may occur.

SUMMARY

An object of the invention is to provide a roof cutter holder adjustment device which avoids the aforesaid disadvantages and enables a locking mechanism which prevents unintentional adjusting movements of the roof cutter holder adjustment device to be mounted and released in a simple manner.

This object can be achieved with regard to the roof cutter holder adjustment device in that the head plate has at least one fastening device, to which a securing element which can be slipped onto the free end of the input shaft can be fastened in a rotationally fixed manner in the mounted state.

In a solution according to the invention, a securing element is provided which can be slipped onto the free end of the input shaft, with which the gear unit and the worm wheel are actuated, wherein this securing element can be fastened to the head plate in a rotationally fixed manner by means of a suitable fastening device. Since, the securing element is fixed to the head plate by means of the fastening device, fastening is therefore effected within the construction unit, and therefore the corresponding solution can be used on all plow bodies and plow devices on which such a roof cutter holder adjustment device is mounted or can be used. The combination of a securing element which can be slipped onto the input shaft and of a separate fastening device for locking this securing element in a rotationally fixed manner at the same time ensures that the mounting and removal is also ensured, if need be, at locations where access is difficult.

In at least one configuration, the roof cutter holder adjustment device has, as gear unit, an epicyclic gear unit which is connected to the head plate in a rotationally fixed manner via a pot-like torque reaction absorber, as described in detail in DE 20 2005 016 177 U1, the disclosure of which reference is made for complementing the present disclosure. It can be especially advantageous if the head plate together with the worm wheel, the gear unit and the input shaft form a removable and interchangeable construction unit. However, the present invention can also be advantageously used in other roof cutter holder adjustment devices, in particular in such a roof cutter holder adjustment device in which the worm wheel is actuated through a head plate via any design of an input shaft of a gear unit or the like.

In the simplest configuration, the fastening device can be a screw bolt or the like, with which the securing element is fixed to the head plate in the mounted state by, for example, the securing screw being screwed into a corresponding tapped hole in the head plate. In a preferred configuration, the fastening device comprises a groove-like recess, into which the securing element can be inserted from above in order to lock the securing element in a positive manner against rotation inside the groove-like recess and at the same time pre-position the securing element relative to the fastening device. It can be especially advantageous if the groove-like recess extends from a longitudinal edge of the head plate up to behind the passage for the input shaft. The groove-like recess at or close to the longitudinal edge can also preferably be provided with edge recesses which form undercuts and into which a securing catch which can be releasably connected to the securing element and has a retaining plate can be pushed. In this configuration, therefore, a multi-piece fastening device is used which in particular enables the securing element to be locked by positive locking and therefore also enables the roof cutter holder adjustment device to be fixed in a specific extension position.

In another advantageous configuration, the input shaft can have at the free end a polygonal recess, such as, for example, a square recess, for applying an adjusting tool. It goes without saying that the securing element then preferably has a polygonal projection or square projection which can be pushed into the polygonal recess in a positive-locking manner in order to prevent rotation of the input shaft by the interplay of polygonal recess and polygonal projection in the mounted state if rotation of the securing means is to be prevented via the fastening device.

The invention can also be achieved by a securing element for a roof cutter holder adjustment device of appropriate design, wherein, according to an aspect of the invention, the securing element can be slipped releasably onto the free end of the input shaft and can be fastened in a rotationally fixed manner to a fastening device formed on the head plate. It can be especially advantageous if the securing element is designed as a securing plate, to the underside of which a polygonal projection which can be pushed into the polygonal recess on the input shaft in a positive-locking manner is fastened and to the rear side of which a securing catch is releasably fastened. To lock the securing catch, it can be especially advantageous if, as explained further above, the head plate has a groove-like recess as part of the fastening device. The securing plate can have, in particular on its rear side, a slot, into which a retaining block of the securing catch can be pushed, said retaining block being formed on the securing catch above a retaining plate. Positive locking of the securing catch in the groove-like recess in the head plate can then be achieved by the retaining plate, while the securing plate is locked in a positive manner relative to the groove-like recess by virtue of the slot and the retaining block engaging one inside the other. Due to the multi-piece construction, it is at the same time ensured that the fastening device can be released again relatively easily.

According to another advantageous configuration, a threaded bolt can be arranged parallel to the axis of the slot, and the retaining block has a transverse hole for pushing the securing catch onto the threaded bolt. The threaded bolt can be, for example, part of a cap screw which is anchored in the securing plate in a suitable manner. After the retaining block has been pushed on, the lock nut or the like can then be screwed onto the free end of the threaded bolt, said lock nut being the only element that has to be released by means of a wrench in order to knock the retaining block out of the slot, e.g. by means of hammer blows, and then remove the securing plate upward.

In order to create as little clearance space as possible for the briquetting of coal fines or the like, it can be especially advantageous if the securing plate has a semicircular front side, and a recess is arranged on the underside around the polygonal projection.

BRIEF DESCRIPTION OF THE DRAWINGS

Further advantages and configurations of the invention follow from the description below of exemplary embodiments schematically shown in the drawing, in which.

DETAILED DESCRIPTION

Figure 1:
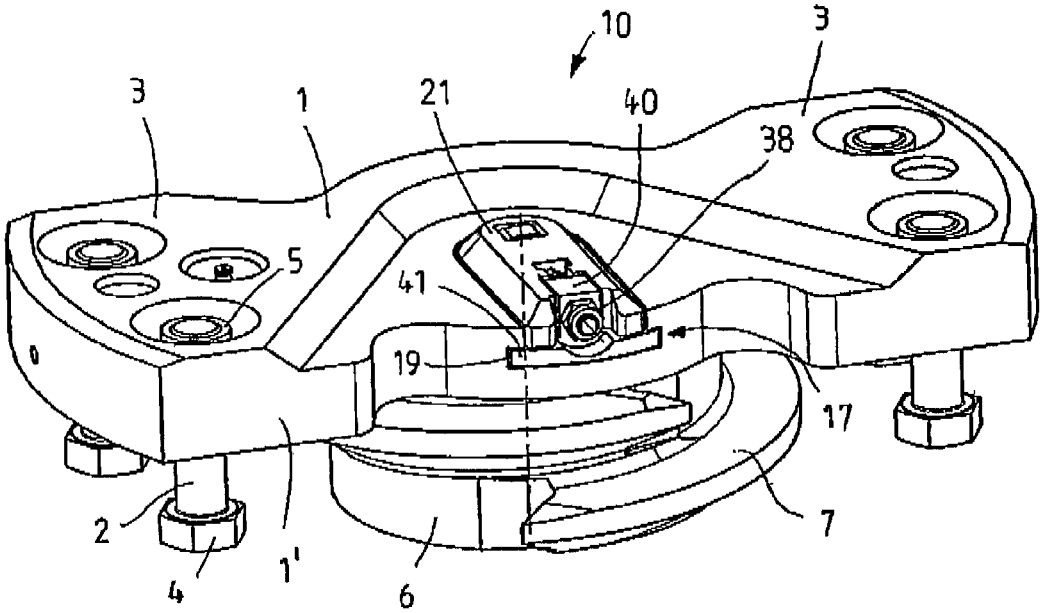
FIG. 1 shows a perspective view of a roof cutter holder adjustment device according to the invention in a first exemplary embodiment.
Figure 2:
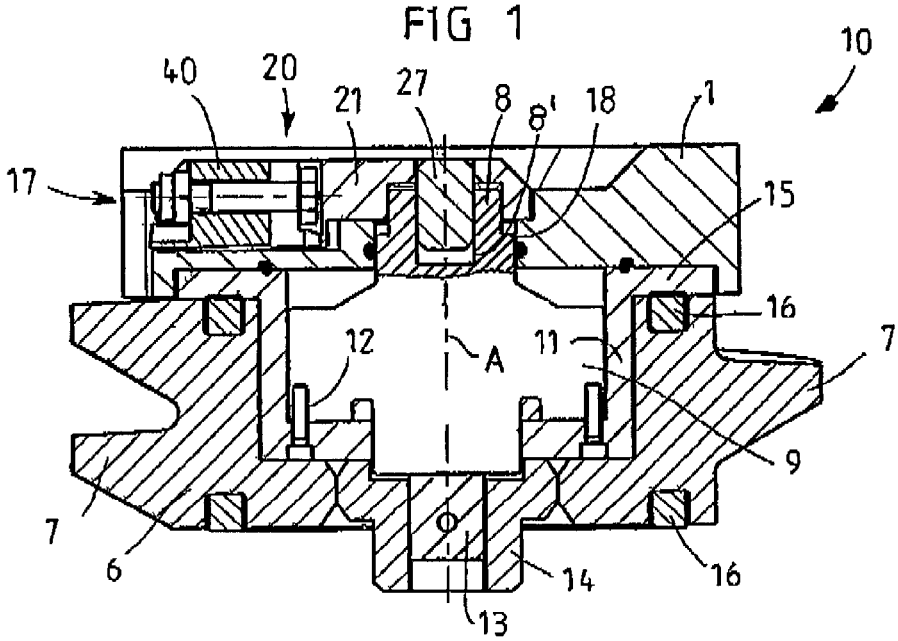
FIG. 2 schematically shows, in a highly simplified manner, a vertical section through the roof cutter holder adjustment device according to FIG. 1.

FIGS. 1 and 2 show a roof cutter holder adjustment device 10 in a configuration as can be used as a complete construction unit on a plow body (not shown in any more detail in FIGS. 1 and 2), such as, for example, on the plow body of a drag-hook plow. The roof cutter holder adjustment device has a robust head plate 1 which can be fastened in the fitted position behind a roof cutter holder to the plow body of a winning plow for underground mining by means of fastening screws 2—four fastening screws 2 in this case. The fastening screws 2 pass in pairs through respective side wings 3 of the head plate 1, and in the fitted position the screw heads 4 of the fastening screws 2 lie in corresponding apertures in the plow body in a rotationally fixed manner, and therefore only fastening nuts 5 have to be tightened from above in order to lock the head plate 1 or lift it from the plow body when head nuts 5 are released.

To vertically adjust the roof cutter holder (not shown), the roof cutter holder adjustment device 10 has a worm wheel 6 which is rotatable relative to the head plate 1 and which is provided at its circumference with a robust worm wheel helix 7 which winds around it by slightly more than one full turn over an angle of approximately 380°-400°. In the fitted position on the plow body, the helix 7 of the worm wheel 6 meshes with a toothed rack (not shown) which is formed on the roof cutter holder—as known per se to the person skilled in the art in the case of coal plows—in order to move the roof cutter holder upward or downward by rotating the worm wheel 6. In the exemplary embodiment in FIGS. 1 and 2, an epicyclic gear unit 9 is interposed between the worm wheel 6 and an input shaft 8 indicated schematically in FIG. 2, the rotary movement which is introduced into the input shaft 8 via a tool being geared down to a considerable extent by said epicyclic gear unit 9 in order thus to minimize the expenditure of force for a miner for adjusting the roof cutter holder. The input shaft 8 for the epicyclic gear unit 9 is disposed approximately perpendicularly and is accessible from above via the passage 18 in the head plate 1. The free end of the input shaft 8 is provided with a polygonal (square in this case) recess 8'. The input shaft could also consist of a bush, of an axle journal or of a polygonal recess of any kind for applying a tool and is connected to the gear unit directly or via further gearing elements. The epicyclic gear unit 9 is designed as a torque or force multiplier and is of such a compact construction that it can be arranged within the worm wheel 6 together with a pot-like torque reaction absorber 11, to which the epicyclic gear unit 9 is screwed by means of screws 12. The output shaft 13 of the gear unit 9 in turn engages in a positive-locking manner in a bearing bush 14, which at the same time meshes with the worm wheel 6 in a rotationally fixed manner, e.g. via suitable keying, such that the output movement of the gear unit 9 is introduced as rotary movement into the worm wheel 6. For the structural design of the epicyclic gear unit 9 (not shown in any more detail), reference is made—as already mentioned further above—to DE 20 2005 016 177 U1.

The pot-like torque reaction absorber 11 accommodates the epicyclic gear unit 9 and is preferably anchored on the underside of the head plate 1 in a positive-locking manner via positive-locking means, such as, in particular, asymmetrical lugs 15 at the pot rim, such that, when the ring gear of the epicyclic gear unit is stationary, the planet gears inside the epicyclic gear unit can revolve with a sun gear. The good mobility of the worm wheel 6 relative to the head plate 1 or the torque reaction absorber 11 is achieved by means of two sliding rings 16 which act, on the one hand, between the lugs 15 and the top side of the worm wheel 6 and, on the other hand, between the underside of the worm wheel 6 and a base of an accommodating recess for the roof cutter adjustment device 10 in the plow body.

The input shaft 8 of the roof cutter adjustment device 10 can only be actuated when the locking device (designated overall in the figures by reference numeral 20) for locking the rotary position of the worm wheel 6 and thus also the push-out length of the roof cutter holder is removed. The locking device 20 is of multi-piece construction and comprises a securing element 21 interacting with the input shaft 8, a securing catch 40 which can be releasably connected to said securing element 21, and a groove-like recess 17 in the head plate 1, to which groove-like recess 17 the securing catch 40 can be fastened by positive locking in such a way as to prevent rotation, in order at the same time to secure the securing element 21 against release.

It can be readily seen from FIG. 1 that the groove-like recess 17 in the head plate 1 extends from the longitudinal edge 1' (the front longitudinal edge in this case) up to beyond the passage (18, FIG. 2) for the input shaft 8 between the two wings 3 and has, relative to the top side of the head plate 1, said top side being partly sunken in this region, a rectangular cross section which ends in an approximately semicircular head section formed substantially rotationally symmetrically to the rotation axis A of the worm wheel. Two lateral edge recesses 19 are formed in the bottom region of the groove-like recess 17, close to the longitudinal edge 1', said edge recesses 19 forming undercuts in order to anchor the securing catch 40 in the groove-like recess 17 in a positive-locking manner, as will be explained later.

Figure 4:
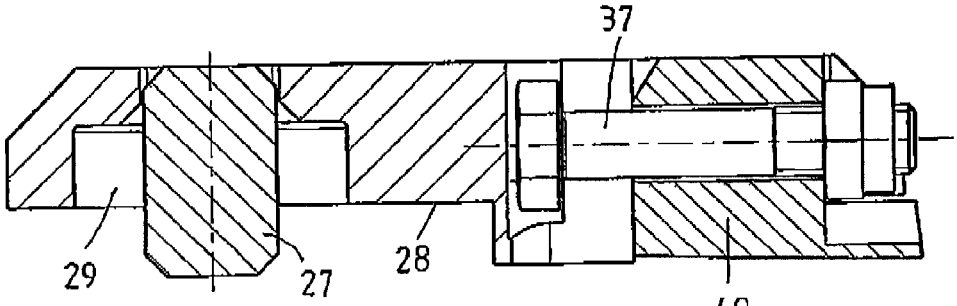
FIG. 4 shows a horizontal section through the fastening elements according to FIG. 3.
Figure 3:
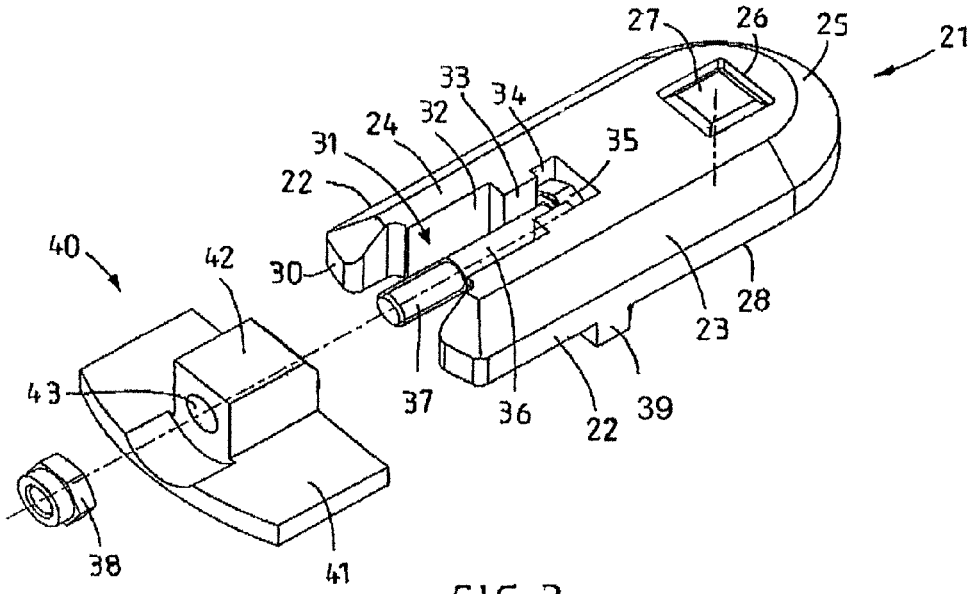
FIG. 3 shows in a perspective exploded illustration the fastening elements for the roof cutter adjustment device according to FIGS. 1 and 2.

The construction of the securing element 21 and of the securing catch 40 will now be explained first of all with reference to FIGS. 3 and 4, in which the securing element and the securing catch are shown separately. The perspective view in FIG. 3 readily shows that the securing element 21 consists of a preferably one-piece securing plate 23 which has a longer strip-shaped section 24 and a semicircular head section 25. Made in the center of the head section 25 is a window 26, which is square in this case and in which a square pin 27 is fastened, which projects by a few centimetres beyond the underside 28, as can readily be seen from FIG. 4. Formed concentrically around the center axis of the square pin 27 is a recess 29, into which the end section of the input shaft (8, FIG. 2) can plunge in the mounted state so that the square pin 27 can engage in the corresponding square recess (8', FIG. 2) in a positive-locking manner in order to fix the worm wheel and the epicyclic gear unit in their rotary position. The shape of the securing plate 23 is adapted overall in such a way that said securing plate 23 can be inserted from above into the corresponding groove-like recess 17 in a substantially positive-locking manner so that not only can the polygonal pin 27 plunge into the input shaft 8 but the securing plate can also plunge partially into the head plate. The elongated configuration of the securing element 21 as securing plate 23 can at the same time ensure that, if the polygonal pin 27 plunges only partially into the associated polygonal recess (8', FIG. 2), the worm wheel can be adjusted at least until the securing plate 21 is in alignment with the groove-like recess (17, FIG. 1) and can be lowered down to the root of the groove-like recess. The transverse web 39 on the underside 28 of the securing plate 23 then rests on the root of the groove-like recess, and a clearance space into which a retaining plate 41 of the securing catch 40 can be pushed is produced toward the rear side 30 of the securing plate 23, below the underside 28. At the same time, a multi-stepped slot 31 is formed on the rear side 30 of the securing plate 23, and this multi-stepped slot 31 here has a first slot section 32 into which a retaining block 42 of the securing catch 40 can be pushed, said retaining block 42 projecting upward above the retaining plate 41. In the exemplary embodiment shown, the slot 31 has another slot section 34 of rectangular cross section which is widened relative to a narrower intermediate section 33 and into which the head 35 of a fastening screw 36 can be pushed in such a way that the threaded shank 37 of the fastening screw 36 lies parallel to the slot axis. The retaining block 42 is provided centrally with a transverse hole 43 in order to push the retaining block 42 onto the threaded shank 37 of the screw bolt 36 and then fixedly anchor the securing plate 23 and the securing catch 40 to one another by means of a lock nut 38.

The securing element 21 is locked in the groove-like recess (17, FIG. 1) in the head plate 1 by means of the securing catch 40 owing to the fact that the retaining plate 41 is wider than the securing plate 23 and projects on both sides beyond the side walls 22 of the latter. In the mounted state, as shown in FIG. 1, the retaining plate 41 can plunge with widened or laterally protruding sections into the edge recesses (19, FIG. 1). The shape of the groove-like recess prevents the worm wheel from being able to be rotated about its rotation axis when the securing element 21 is slipped on. The securing catch 40 in turn prevents, by means of the retaining plate 41, the securing element 21 slipped on from above from being able to be removed upward when the fastening screw 36 is tightened. For the release, it is only necessary to remove the lock nut 38, as a result of which the securing catch 40 can be knocked out of the slot and then the securing element 21 can be removed upward. By applying a suitable turning tool again, which engages in the polygonal recess 8' in the input shaft 8, the worm wheel 6 can (only) then be adjusted. The adjustment can also be effected by means of the securing element 21.

Figure 5:
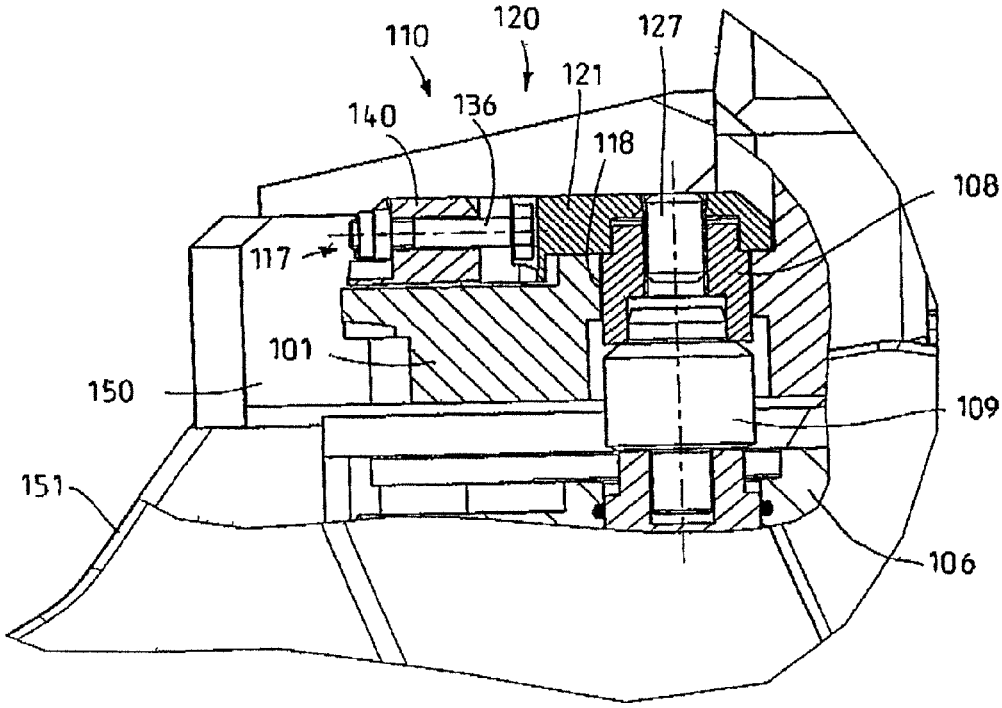
FIG. 5 schematically shows, in a highly simplified manner, a roof cutter holder adjustment device according to a second exemplary embodiment in the fitted position on a plow body.

FIG. 5 shows a second exemplary embodiment of a slightly modified roof cutter holder adjustment device 110. The construction of the securing element 121 and of the securing catch 140 is virtually identical to that in the previous exemplary embodiment, for which reason the configuration of these elements including the threaded bolt 136 connecting the two elements 121, 140 is not described again. Here, however, the locking device 120 is used on a head plate 101 which is designed to be substantially more robust than in the previous exemplary embodiment and is mounted, if need be also welded in place, on a plow body 150 in which a worm wheel 106 (only intimated) cannot be removed upward when the head plate is detached but can removed toward the rear side 151 of the plow body 150. When the locking device 120 is detached and disengaged from the groove-like recess 117 in the head plate 101, both an input shaft 108 and a gear unit 109 of cartridge-like design can be removed upward through the passage 118 in the head plate 1 before the worm wheel 106 is then pulled off to the rear. Here, the gear unit 109 can have a different construction from that in the previous exemplary embodiment.

For the person skilled in the art, numerous modifications which are to come within the scope of protection of the attached claims emerge from the above description. As the two exemplary embodiments already show, the fastening device according to an aspect of the invention can be used in virtually all possible configurations of roof cutter holder adjustment devices in which the worm wheel is actuated from above through a head plate for adjusting the cutter holder, since, for locking the fastening device, only, for example, one groove-like recess has to be made in the head plate in order to then be able to use the securing element and the securing catch 40, as shown. The exemplary embodiments and the figures show a gear unit interposed between input shaft and worm wheel. However, the invention and in particular the securing element for locking the roof cutter adjustment device or the worm wheel can also be used in a gearless roof cutter adjustment device with directly driven worm wheel. The input shaft and the securing element can also engage one inside the other in a positive-locking manner by means of projections and recesses of a different form.

It will be appreciated that various of the above-disclosed and other features and functions, or alternatives or varieties thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A roof cutter holder adjustment device for a roof cutter holder arranged in a vertically adjustable manner on a plow body of a winning plow, comprising:

a worm wheel for interacting with a rack on the roof cutter holder;

an input shaft for actuating the worm wheel; and a head plate which has a passage for the input shaft and which is fastenable or is fastened to the plow body in a rotationally fixed manner, wherein the head plate comprises at least one fastening device;

a securing element configured to engage the fastening device on the head plate, and the securing element configured to engage a free end of the input shaft in a rotationally fixed manner; and an epicyclic gear unit interposed between the input shaft and the worm wheel.

2. The roof cutter holder adjustment device as claimed in claim 1, wherein the epicyclic gear unit is connected to the head plate in a rotationally fixed manner via a torque reaction absorber, wherein the worm wheel, the epicyclic gear unit and the input shaft form an assembly.

3. The roof cutter holder adjustment device as claimed in claim 1, wherein the fastening device comprises a recess, into which the securing element is insertable from above.

4. The roof cutter holder adjustment device as claimed in claim 3, wherein the recess comprises a groove that extends from a longitudinal edge of the head plate up to behind the passage for the input shaft.

5. The roof cutter holder adjustment device as claimed in claim 4, wherein the groove at or close to the longitudinal edge is provided with edge recesses, which form undercuts and into which a securing catch which is releasably connected to the securing element and has a retaining plate can be pushed.

6. The roof cutter holder adjustment device as claimed in claim 1, wherein the input shaft has at the free end a polygonal recess for applying an adjusting tool.

7. A roof cutter holder adjustment device as claimed in claim 1, wherein the securing element is configured to be releasably disposed onto the free end of the input shaft and is fastenable in a rotationally fixed manner to the fastening device formed on the head plate.

8. The roof cutter holder adjustment device as claimed in claim 1, wherein the securing element is a securing plate, on the underside of which a polygonal projection configured to be inserted into a polygonal recess at the free end of the input shaft in a positive-locking manner is formed or fastened and to the rear side of which a securing catch is releasably fastened.

9. The roof cutter holder adjustment device as claimed in claim 8, wherein the securing plate has a semicircular front side, and a recess is arranged on the underside around the polygonal projection.

10. The roof cutter holder adjustment device as claimed in claim 1, wherein the securing plate has, on its rear side, a slot, into which a retaining block of the securing catch can be pushed, said retaining block being formed on the securing catch above a retaining plate.

11. The roof cutter holder adjustment device as claimed in claim 10, wherein a threaded bolt is arranged parallel to the axis of the slot, and in that the retaining block has a transverse hole for pushing said retaining block onto the threaded bolt.

12. A securing element for an adjustment device for a roof cutter holder on a plow body, comprising a worm wheel for interacting with a rack on the roof cutter holder, an input shaft for actuating the worm wheel, and a head plate which has a passage for the input shaft and which is fastenable or is fastened to the plow body in a rotationally fixed manner, wherein the head plate comprises at least one fastening device, a securing element configured to be releasably disposed onto a free end of the input shaft in a rotationally fixed manner and is fastenable in a rotationally fixed manner to a fastening device formed on the head plate.

13. The securing element as claimed in claim 12, wherein the securing element is a securing plate, on the underside of which a polygonal projection configured to be inserted into a polygonal recess at the free end of the input shaft in a positive-locking manner is formed or fastened and to the rear side of which a securing catch is releasably fastened.

14. The securing element as claimed in claim 12, wherein the securing plate has, on its rear side, a slot, into which a retaining block of the securing catch can be pushed, said retaining block being formed on the securing catch above a retaining plate.

15. The securing element as claimed in claim 14, wherein a threaded bolt is arranged parallel to the axis of the slot, and in that the retaining block has a transverse hole for pushing said retaining block onto the threaded bolt.

16. The roof cutter holder adjustment device as claimed in claim 14, wherein the securing plate has a semicircular front side, and a recess is arranged on the underside around the polygonal projection.

17. A roof cutter holder adjustment device for a roof cutter holder on a plow body, comprising:

a worm wheel for interacting with a rack on the roof cutter holder;

an input shaft for actuating the worm wheel;

a head plate which has a passage for the input shaft and which is fastenable or is fastened to the plow body in a rotationally fixed manner, wherein the head plate comprises at least one fastening device;

a securing element configured to engage the fastening device on the head plate:

wherein the securing element is configured to engage a free end of the input shaft in a rotationally fixed manner;

wherein the input shaft has at the free end a polygonal recess configured to receive an adjusting tool.

18. The roof cutter holder adjustment device as claimed in claim 17, further comprising an epicyclic gear unit coupled to the head plate in a rotationally fixed manner via a torque reaction absorber.

19. A roof cutter holder adjustment device for a roof cutter holder on a plow body, comprising:

a worm wheel for interacting with a rack on the roof cutter holder;

an input shaft for actuating the worm wheel;

a head plate which has a passage for the input shaft and which is fastenable or is fastened to the plow body in a rotationally fixed manner, wherein the head plate comprises at least one fastening device having a groove;

a securing element configured to engage the groove on the fastening device from above;

wherein the securing element is configured to engage a free end of the input shaft in a rotationally fixed manner.

20. The roof cutter holder adjustment device as claimed in claim 19, further comprising an epicyclic gear unit coupled to the head plate in a rotationally fixed manner.

* * * * *